US011883725B1

(12) United States Patent
Flowers

(10) Patent No.: US 11,883,725 B1
(45) Date of Patent: Jan. 30, 2024

(54) BALL GAME AND METHOD OF PLAYING

(71) Applicant: Core Sports Revolution, LLC, Alexis, IL (US)

(72) Inventor: Kyle Flowers, Alexis, IL (US)

(73) Assignee: Core Sports Revolution LLC, Alexis, IL (US)

( * ) Notice: Subject to any disclaimer, the term of this patent is extended or adjusted under 35 U.S.C. 154(b) by 0 days.

(21) Appl. No.: 17/241,057

(22) Filed: Apr. 26, 2021

Related U.S. Application Data

(60) Provisional application No. 63/015,535, filed on Apr. 25, 2020.

(51) Int. Cl.
*A63B 63/08* (2006.01)

(52) U.S. Cl.
CPC ..... *A63B 63/08* (2013.01)

(58) Field of Classification Search
CPC ..... A63B 63/00; A63B 63/08; A63B 63/083; A63B 67/002
See application file for complete search history.

(56) References Cited

U.S. PATENT DOCUMENTS 3,588,103 A * 6/1971 Fuller ..... A63B 63/083 473/470
4,453,720 A * 6/1984 King ..... A63B 37/14 473/473
5,048,845 A * 9/1991 Dunipace ..... A63B 67/06 273/400
6,494,455 B1 * 12/2002 Headrick ..... A63B 63/00 273/400
6,692,385 B2 * 2/2004 Walker, Jr. ..... A63B 69/0071 473/447
7,766,771 B2 * 8/2010 Vysosias ..... A63B 67/002 473/472
2004/0204269 A1 * 10/2004 Miro ..... A63B 67/002 473/472
2010/0113190 A1 * 5/2010 Vysosias ..... A63B 63/08 473/481
2019/0054358 A1 * 2/2019 Bennrubi ..... A63B 63/007
2019/0224545 A1 * 7/2019 Torgerson ..... A63B 63/007

OTHER PUBLICATIONS

Picuris Pueblo Disc Golf Course, "Hanging basket", published at udisc.com/courses/picuris-pueblo-KtPP by nmassie88, May 2017 (Year: 2017).*
Blue Ribbon Pines Disc Golf Course, "Hanging basket, Hole #16 at Blue Ribbon Pines in East Bethel, MN", published at imgur.com/r0PGV on Jun. 26, 2012 (Year: 2012).*
Brady Disc Golf Course, "April Fools' Showdown", "Famous Brady Hanging basket", published at www.discgolfscene.com/tournaments/April_Fools_Showdown_2017/pictures/258753, Apr. 1, 2017 (Year: 2017).*

* cited by examiner

*Primary Examiner* — Laura Davison
(74) *Attorney, Agent, or Firm* — Hamilton IP Law, PC; Jay R. Hamilton

(57) ABSTRACT

A ball game encouraging team sports on a circular field with concentric rings with a suspended goal positioned in the center of the field. The ball game is played so that points are scored when a ball successfully goes through the goal. The field is generally circular. The position and suspension of the goal is 360 degrees accessible.

13 Claims, 14 Drawing Sheets

BALL GAME AND METHOD OF PLAYING

CROSS REFERENCE TO RELATED APPLICATIONS

Applicant states that this application claims the benefit of U.S. Pat. App. No. 63/015,535 filed on Apr. 25, 2020, which is incorporated by reference herein in its entirety.

FIELD OF INVENTION

This application relates to a ball game and the method of playing the ball game, particularly, the ball receiving system, court organization and the rules of scoring the game when playing using the ball receiving system and the court as disclosed.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

AUTHORIZATION PURSUANT TO 37 C.F.R. § 1.171 (c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BRIEF DESCRIPTION OF THE FIGURES

In order that the advantages of the present disclosure will be readily understood, a more particular description of various illustrative embodiments briefly described above will be rendered by reference to specific embodiments illustrated in the appended drawings. Understanding that these drawings depict only typical embodiments and are not therefore to be considered limiting of its scope unless otherwise indicated in the following claims, the illustrative embodiments will be described and explained with additional specificity and detail through the use of the accompanying drawings.

FIG. 5 is a top view of the Field 15 with illustrative dimensions for each Ring 15-1 to 15-5 (from outer to inner) of the Field 15 playing the Ball Game 10 using the disclosed Goal 1 positioned in the center 15*a* of the field 15 according to the Ball Game Rules as disclosed herein.

FIG. 6 is a top view of the Field 15 as shown at FIG. 5 with the dimensions removed and the value of points scored from each ring for playing the Ball Game 10 using the disclosed Goal 1 positioned in the center 15*a* of the field 15 according to the Ball Game Rules as disclosed herein.

FIG. 6E illustrates that all the rings are closed thus making the four outer rings all worth 5 points each.

DETAILED DESCRIPTION-TABLE OF ELEMENTS

Figure 1:
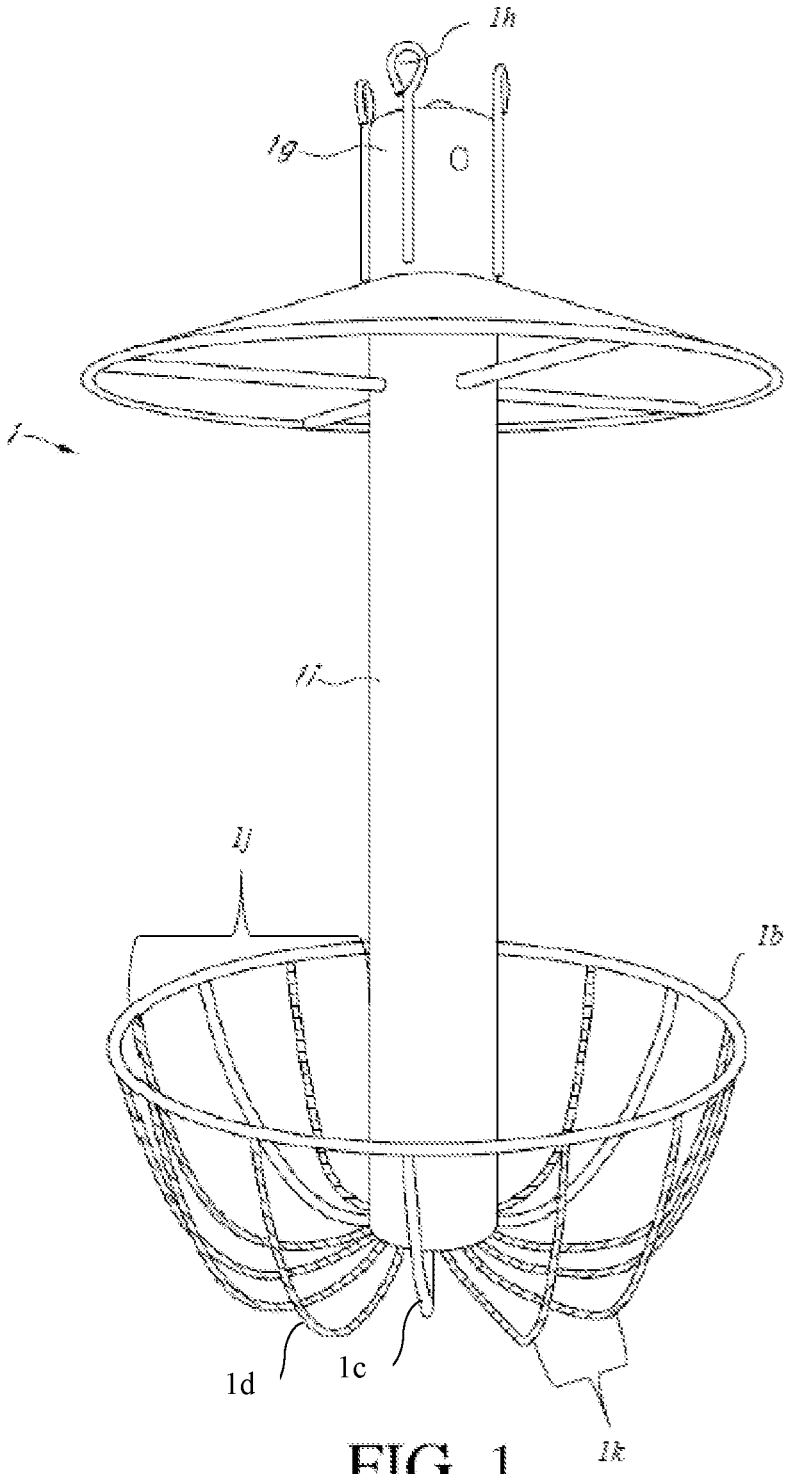
FIG. 1 is a perspective view of the proposed Goal 1 for the Ball Game 10 described and disclosed herein including dimensions for construction.

| Element Description | Element Number |
|---|---|
| Goal | 1 |
| Lower portion | 1a |
| Ball receiver (Ring) | 1b |
| Hoops | 1c |
| Chains | 1d |
| Upper portion | 1e |
| Top Cap | 1f |
| Attachment bell | 1g |
| Eyes | 1h |
| Center Post | 1i |
| Space | 1j |
| Gap | 1k |
| Ball Game | 10 |
| Field | 15 |
| Field Center | 15a |
| Concentric rings (Outer to inner) | 15-1-15-5 |

DETAILED DESCRIPTION

Before the present methods and apparatuses are disclosed and described, it is to be understood that the methods and apparatuses are not limited to specific methods, specific components, or to particular implementations. It is also to be understood that the terminology used herein is for the purpose of describing particular embodiments/aspects only and is not intended to be limiting. As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

"Aspect" when referring to a method, apparatus, and/or component thereof does not mean that limitation, functionality, component etc. referred to as an aspect is required, but rather that it is one part of a particular illustrative disclosure and not limiting to the scope of the method, apparatus, and/or component thereof unless so indicated in the following claims.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and apparatuses.

These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and apparatuses. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and apparatuses may be understood more readily by reference to the following detailed description of preferred aspects and the examples included therein and to the Figures and their previous and following description. Corresponding terms may be used interchangeably when referring to generalities of configuration and/or corresponding components, aspects, features, functionality, methods and/or materials of construction, etc. those terms.

Illustrative Field and Goal

Figure 2:
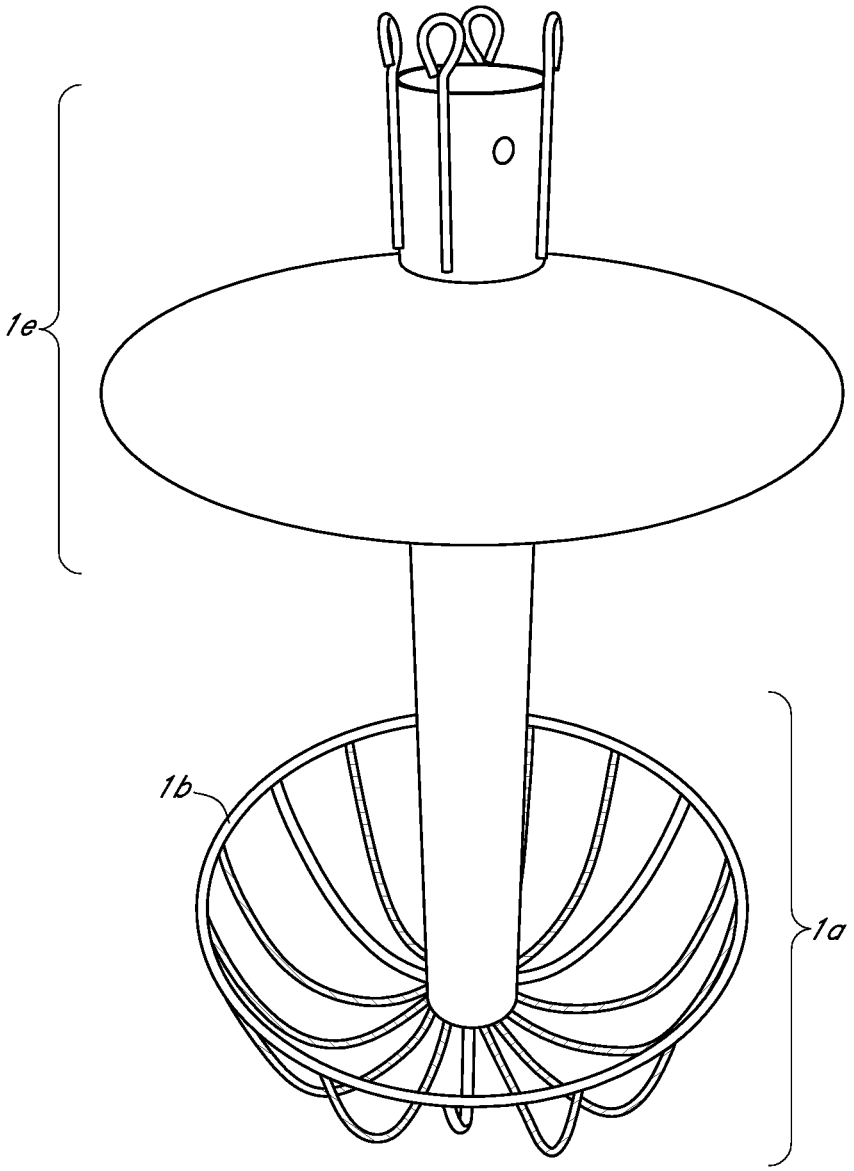
FIG. 2 is another perspective view of the proposed Goal 1 for the Ball Game 10 described and disclosed herein with the dimensions for construction removed.
Figure 5:
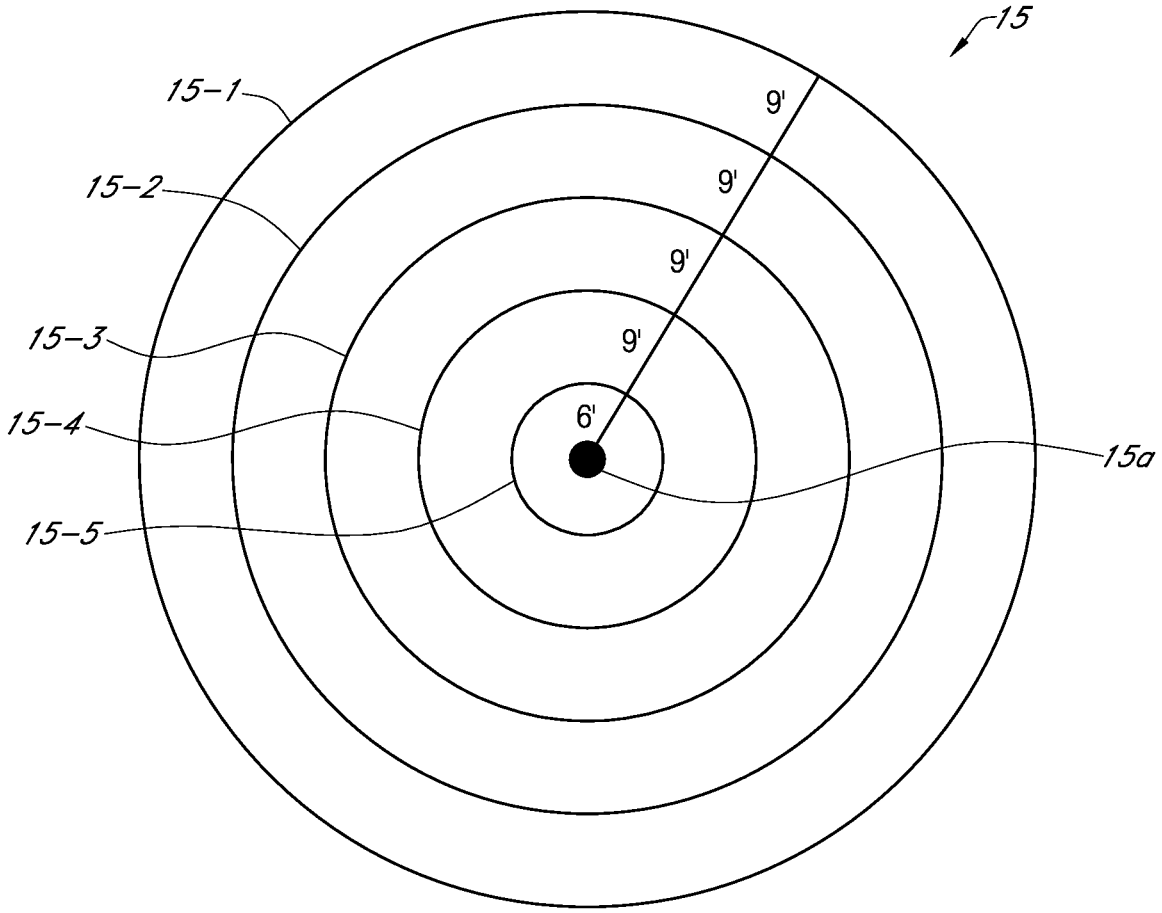
FIGS. 5-6E illustrate the rules, general method of play and dimensions of the field as well as offensive and defensive strategies.

Applicant discloses a Ball Game 10 that encourages team sports. In at least one embodiment, the ball game 10 is played by 7 players against 7 players (7 on 7) and is played with a round ball (not shown) which could be similar to basketball or soccer, on a circular field, as further disclosed and discussed herein. Similar to basketball, a score occurs when the ball successfully goes through the Goal 1. In at least one embodiment of the Ball Game 10, the field 15 is generally circular and may be comprised of multiple concentric rings (15-1 through 15-5). The outer perimeter of the field in one embodiment, as shown and disclosed throughout the accompanying figures and written description herein, has a diameter of eighty-four (84) feet. In the center of the field 15*a* is a 12 ft diameter (6 ft radius) circle known as the "core" as shown at FIG. 5 Surrounding the field center (core) 15*a* are four (4) more concentric "rings", each of which are nine (9) feet in width as shown at FIG. 5. The goal 1 is configured to hang 10 ft above the ground in the center of the field. FIG. 1 is a perspective view of the proposed goal 1 for the Ball Game 10 described and disclosed herein. As shown, the goal 1 is generally comprised of an upper portion 1*e* and a lower portion 1*a* which are connected via a center post. The upper portion 1*e* is configured for hanging the goal 1 from a ceiling or boom (not shown) above the floor or ground via the attachment bell 1*g* discussed further herein. As shown in the accompanying figures, it has a total height of sixty-two (62) inches. The dimension between the lower end of the upper portion 1*e* and the ball receiver ring 1*b* of the lower portion is 36 inches. The diameter of the ball receiver ring 1*b* of the lower portion is also 36 inches to create a space 1*j* between the center post 1*i* and ball receiver ring 1*b* to allow entry of a ball (not shown). FIG. 2 is another perspective view of the proposed Goal 1 for the Ball Game 10 described and disclosed. One of ordinary skill will appreciate that the dimensions presented herein are for the purposes of enablement and other dimensions and spacing may be use without departure from the spirit and intent of the invention disclosed herein.

Figure 3:
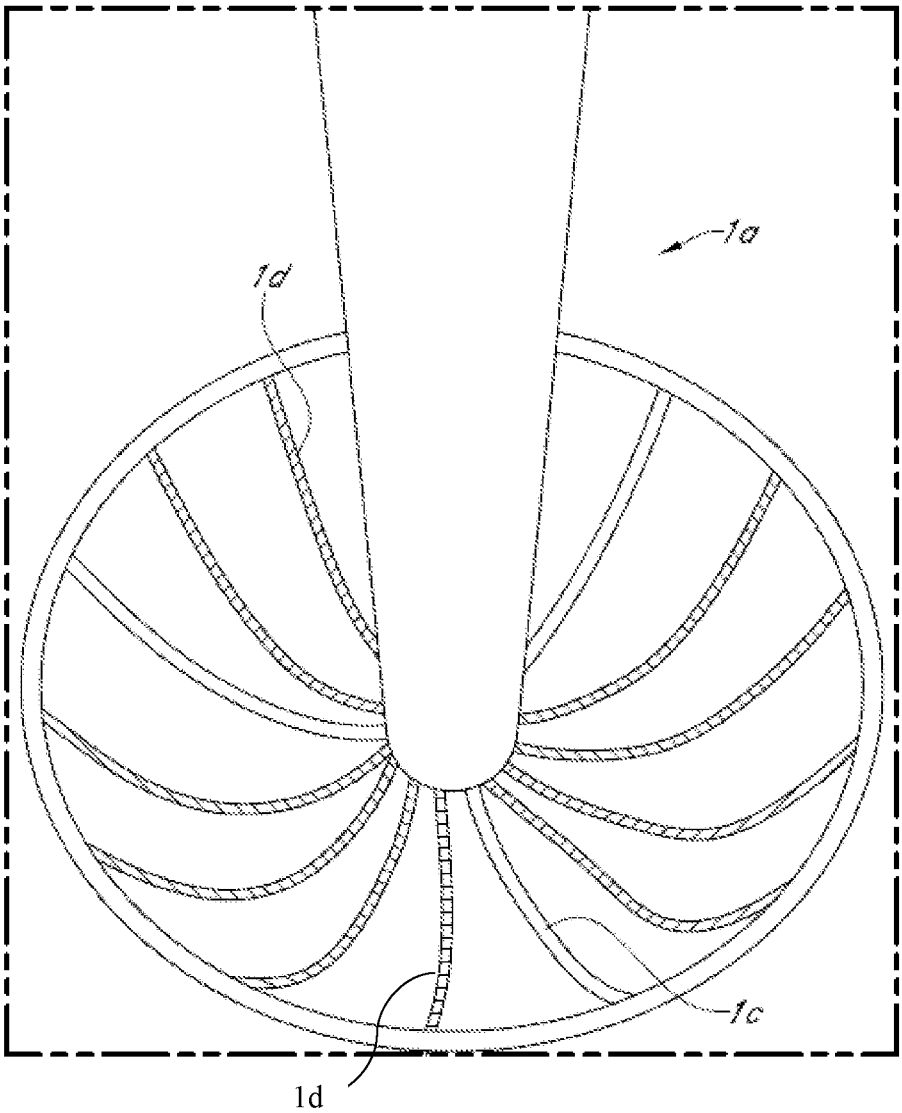
FIG. 3 is another perspective view of the Lower Portion 1*a* of the proposed Goal 1 for the Ball Game 10 described and disclosed herein with the dimensions for construction removed.
Figure 3A:
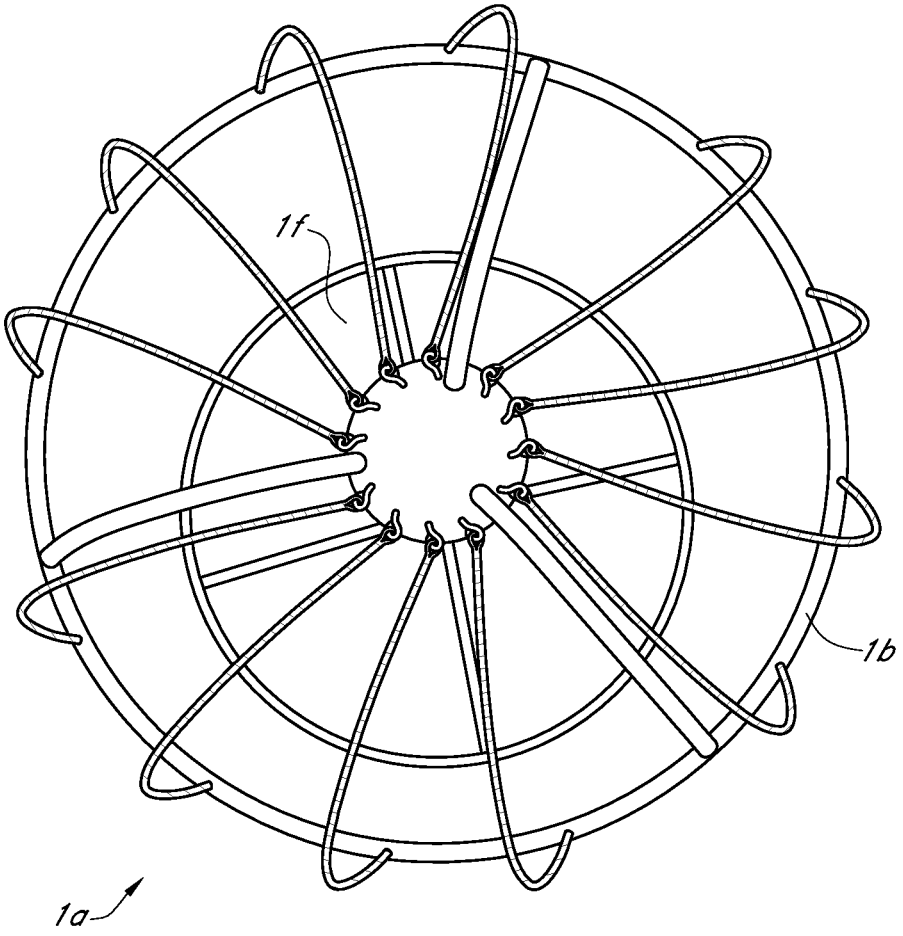
FIG. 3A is another perspective underside view of the Lower Portion 1*a* of the proposed Goal 1 for the Ball Game 10 described and disclosed herein with the dimensions for construction removed.

FIG. 3 is another perspective view of the Lower Portion 1*a* of the proposed Goal 1 for the Ball Game 10 described and disclosed herein. As shown in FIGS. 1-3, the ball receiver ring 1*b* of the lower portion is configured with three (3) rigid hoops which are curved and are connected between the ring 1*b* and the very bottom of the center post 1*i* (see FIG. 3) and are equidistantly spaced around the perimeter of the ball receiver ring 1*b*. Additionally, four (4) chains 1*d* are equidistantly positioned between each hoop around the perimeter of the ring 1*b*. FIG. 3A is another perspective underside view of the Lower Portion 1*a* of the proposed Goal 1 for the Ball Game 10 described and disclosed herein. The chains 1*d* and the hoops 1*c* attached between the ball receiver (ring) 1*b* and the lower portion of the center post 1*i* around the entire perimeter (360 degrees) of the ball receiver 1*b* give the received ball (not shown) "action"—i.e., slowing the ball down, allowing for the ball to bounce around so that the goal 1 as configured receives the ball and allows the ball received to enter, bounce around and out to leave the goal 1 or swish through the goal 1 via the gaps 1*k* between the hoops 1*c* and chains 1*d*. One of ordinary skill will appreciate that additionally other combinations of hoops 1*c* and chains 1*d* may be used. Further, the distance or gap 1*k* allowed between the hoop 1*c* and the chains 1*d* may be varied to accommodate a ball being played, which may vary in diameter.

Figure 4:
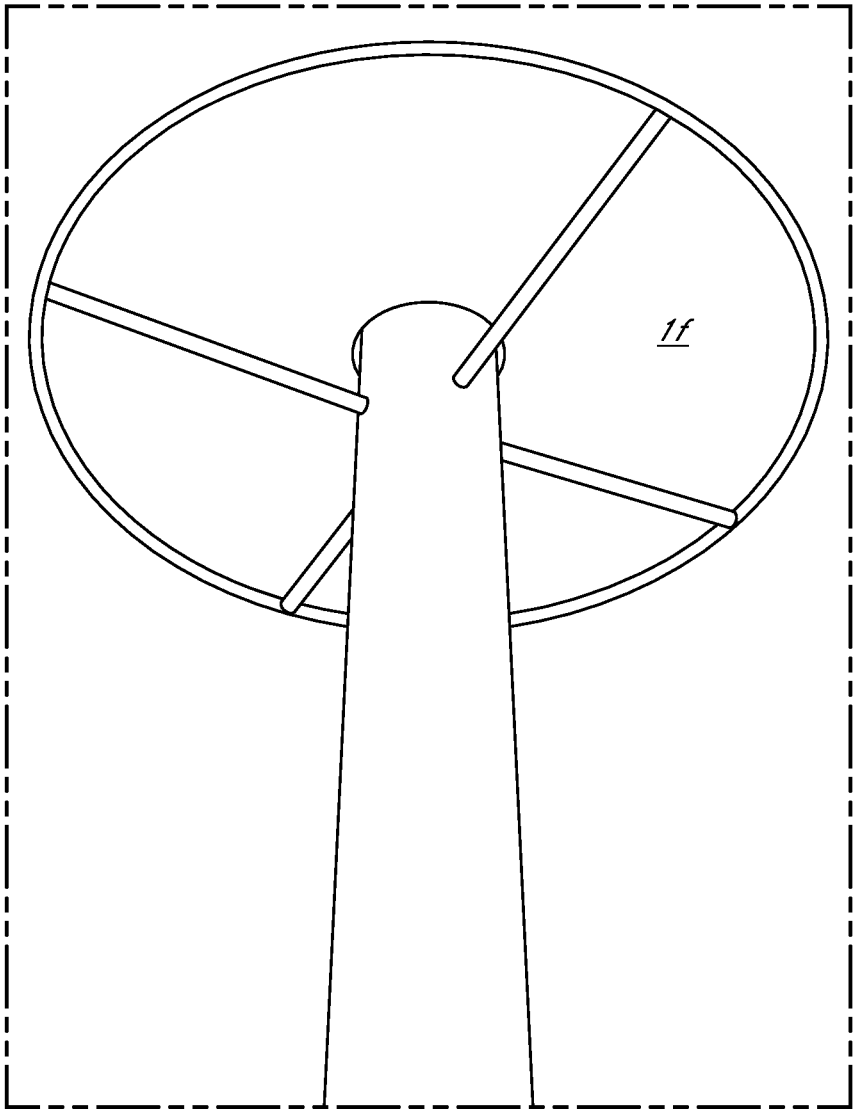
FIG. 4 is a perspective view of the Upper Portion 1*e* of the proposed Goal 1 for the Ball Game 10 described and disclosed herein.
Figure 4A:
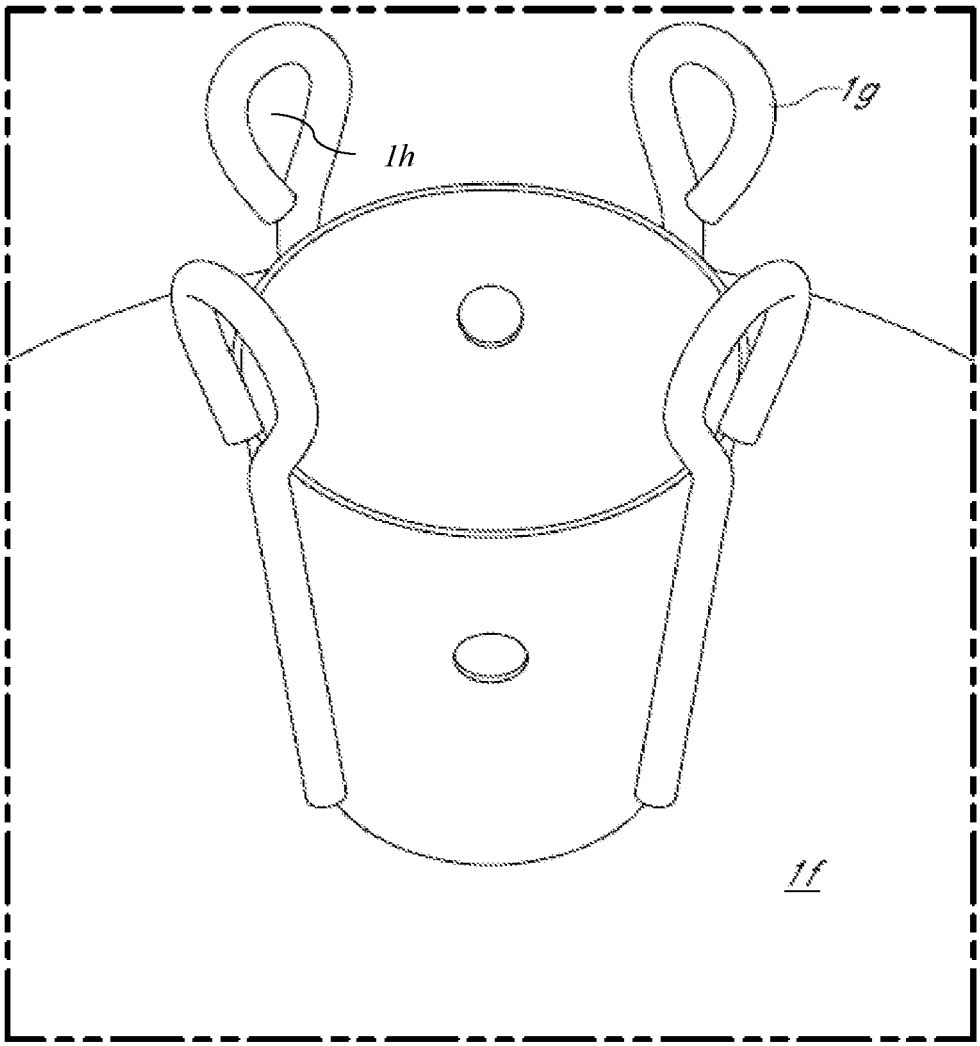
FIG. 4A is a perspective view of the attachment bell 1*g* of the Upper Portion 1*e* of the proposed Goal 1 for the Ball Game 10 described and disclosed herein.

FIG. 4 is a perspective view of the upper portion 1*e* of the proposed goal 1 for the Ball Game 10 described and disclosed herein. FIG. 4A is a perspective view of the attachment bell 1*g* of the upper portion 1*e* of the proposed goal 1 for the Ball Game 10 described and disclosed herein. As should be understood by one of ordinary skill in the art, the goal as disclosed herein is to be affixed to a pole or cable which allows the ball receiver ring to be positioned approximately ten (10) feet above the playing surface, subject to adjustment for ease of play (lower) or increasing difficulty (higher). The attachment bell 1*g* with eyes 1*h* allows for attachment to an overhead pole (hanging from the pole) or a cable (not shown) via the eyes 1*h* or any other means suitable to support suspension of the goal 1 above the playing field 15.

Illustrative Method of Play

Figure 5A:
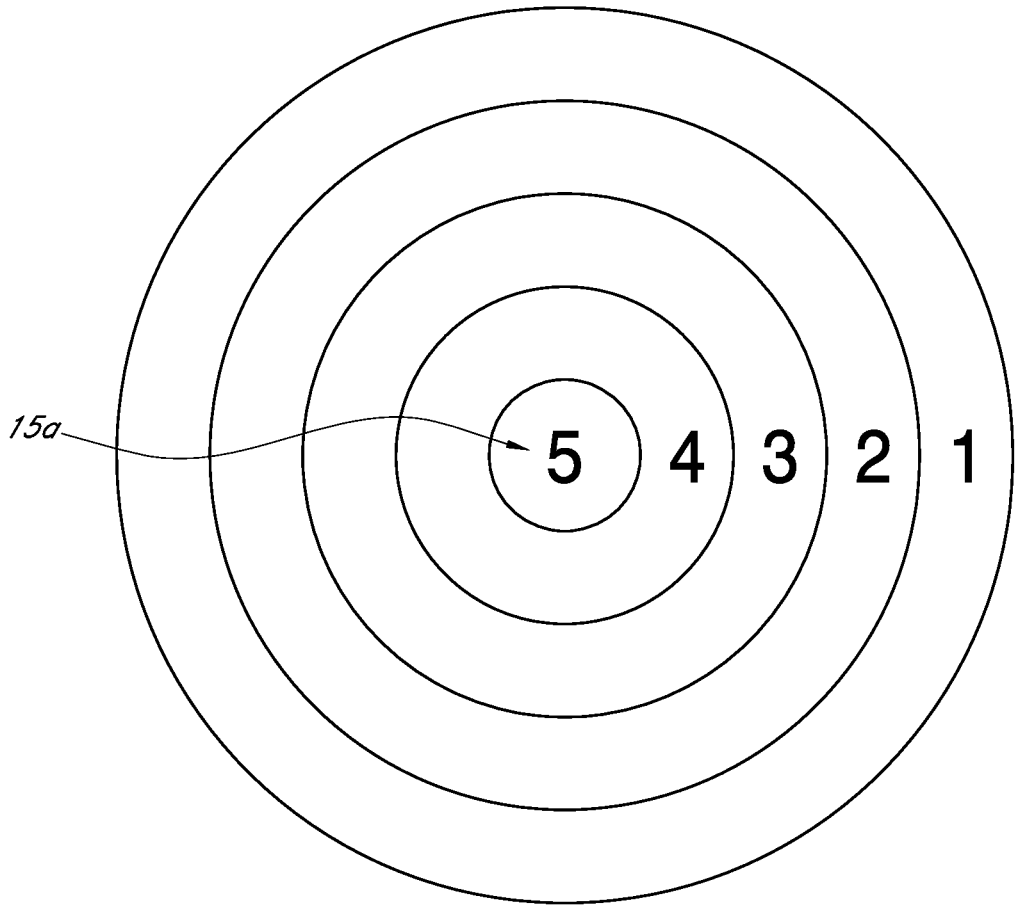
FIG. 5A is a top view of the Field 15 as shown at FIG. 5 with the dimensions removed and the value of points scored from each ring for playing the Ball Game 10 using the disclosed Goal 1 positioned in the center 15*a* of the field 15 according to the Ball Game Rules as disclosed herein.

FIG. 5 is a top view of the Field 15 with illustrative dimensions for each Ring 15-1 to 15-5 (from outer to inner) of the Field 15 playing the Ball Game 10 using the disclosed Goal 1 positioned in the center 15*a* of the field 15 according to the Ball Game Rules disclosed herein. In at least one illustrative embodiment, the Ball Game 10 encourages team sports. In at least one embodiment, the ball game 10 is played by 7 players against 7 players (7 on 7) and is played with a round ball (not shown) which could be similar to basketball or soccer, on a circular field. Similar to basketball, a score occurs when the ball successfully goes through the Goal 1. In at least one embodiment of the Ball Game 10, the field 15 is generally circular and may be comprised of multiple concentric rings (15-1 through 15-5). FIG. 5A is a top view of the Field 15 as shown at FIG. 5 with the dimensions removed and the value of points scored from each ring for playing the Ball Game 10 using the disclosed Goal 1 positioned in the center 15*a* of the field 15 according to the Ball Game Rules as disclosed herein.

Figure 6:
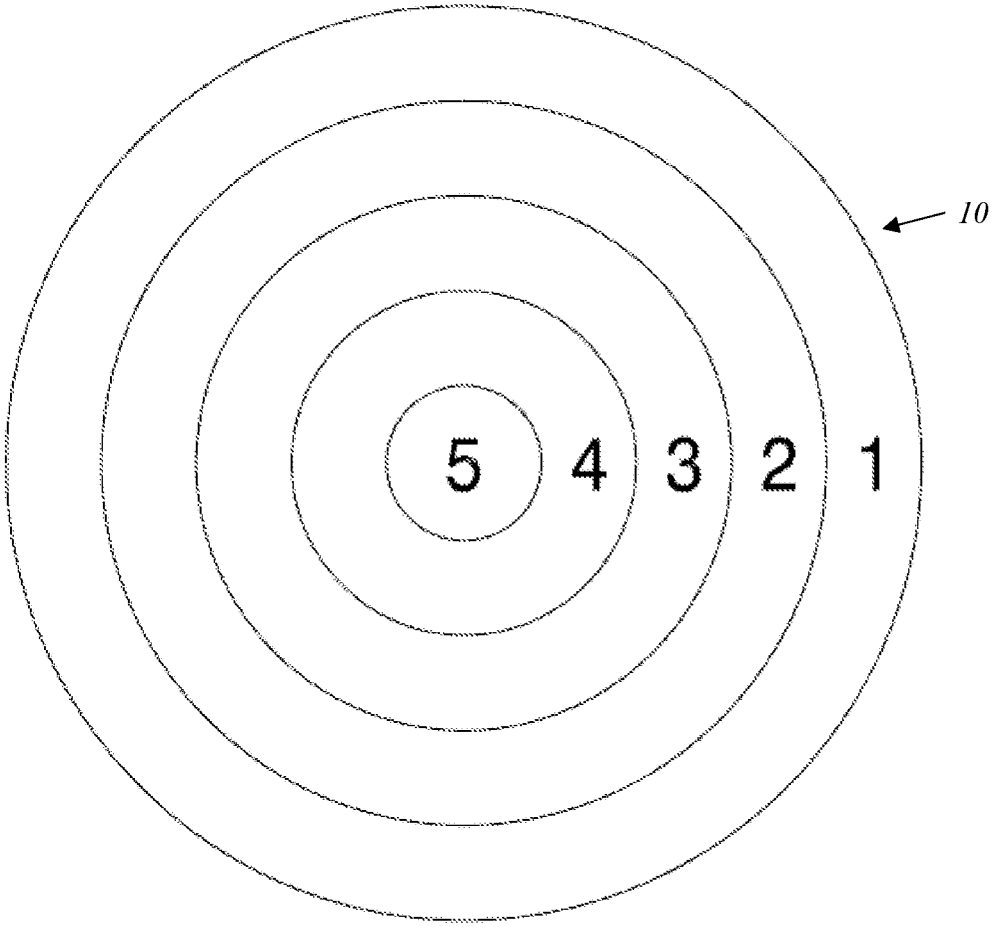
Figure 6A:
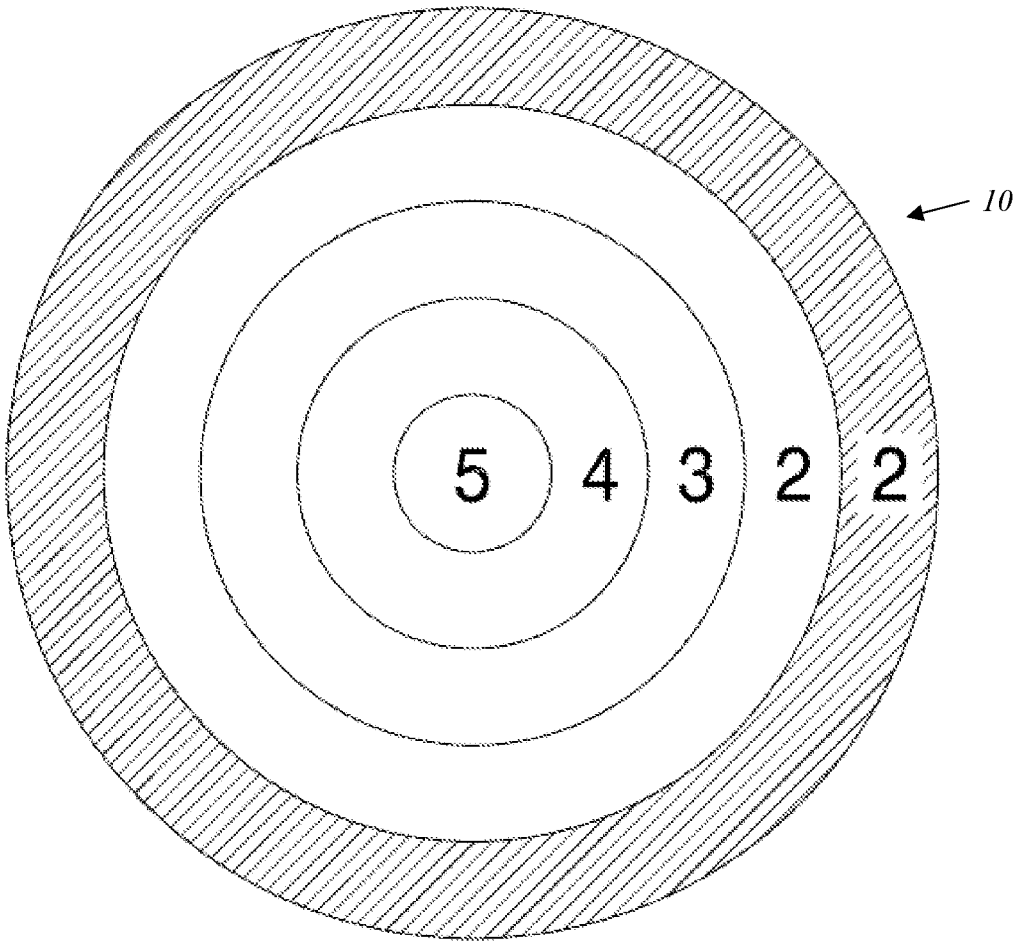
FIG. 6A illustrates that the outer ring is closed thus making the two outer rings all worth 2 points each according to the Ball Game Rules as disclosed herein.
Figure 6B:
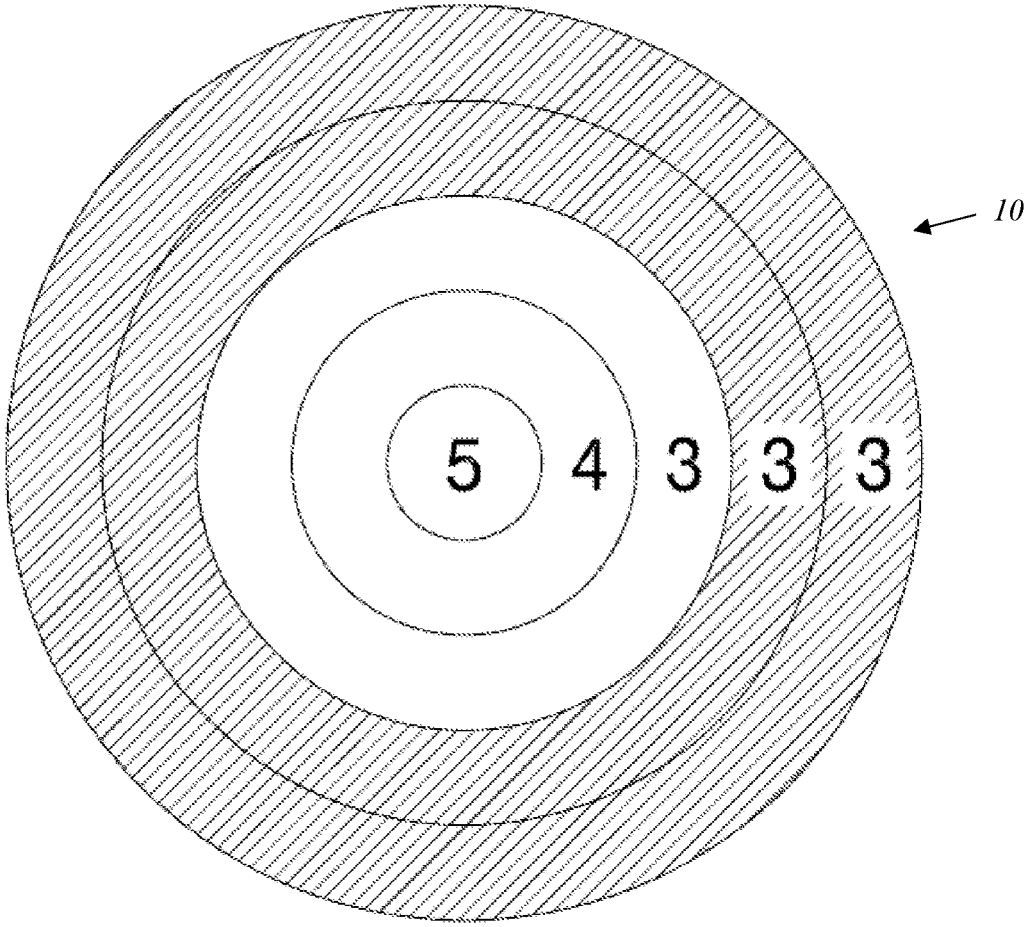
FIG. 6B illustrates that the two outer rings are closed thus making the three outer rings all worth 3 points each according to the Ball Game Rules as disclosed herein.
Figure 6C:
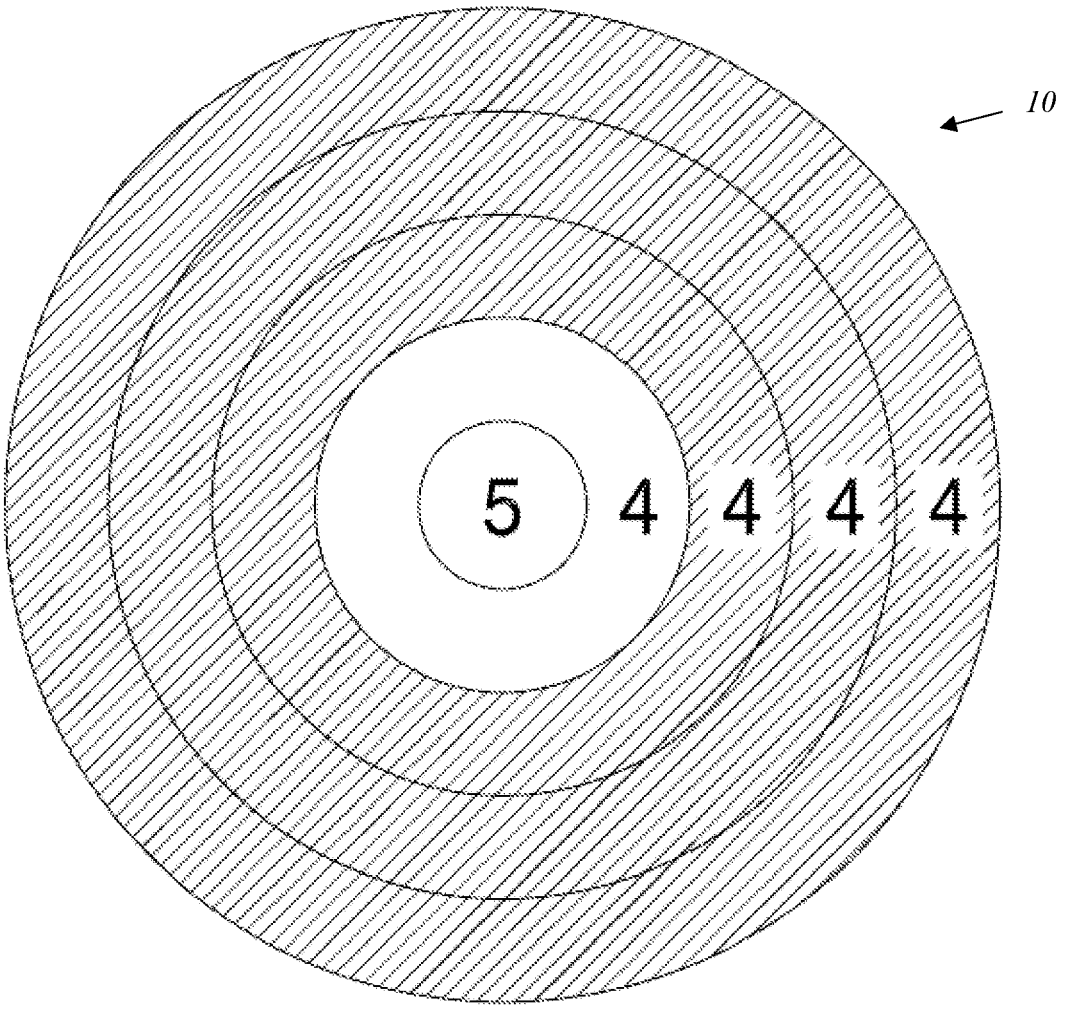
FIG. 6C illustrates that the three outer rings are closed thus making the four outer rings all worth 4 points each according to the Ball Game Rules as disclosed herein.
Figure 6D:
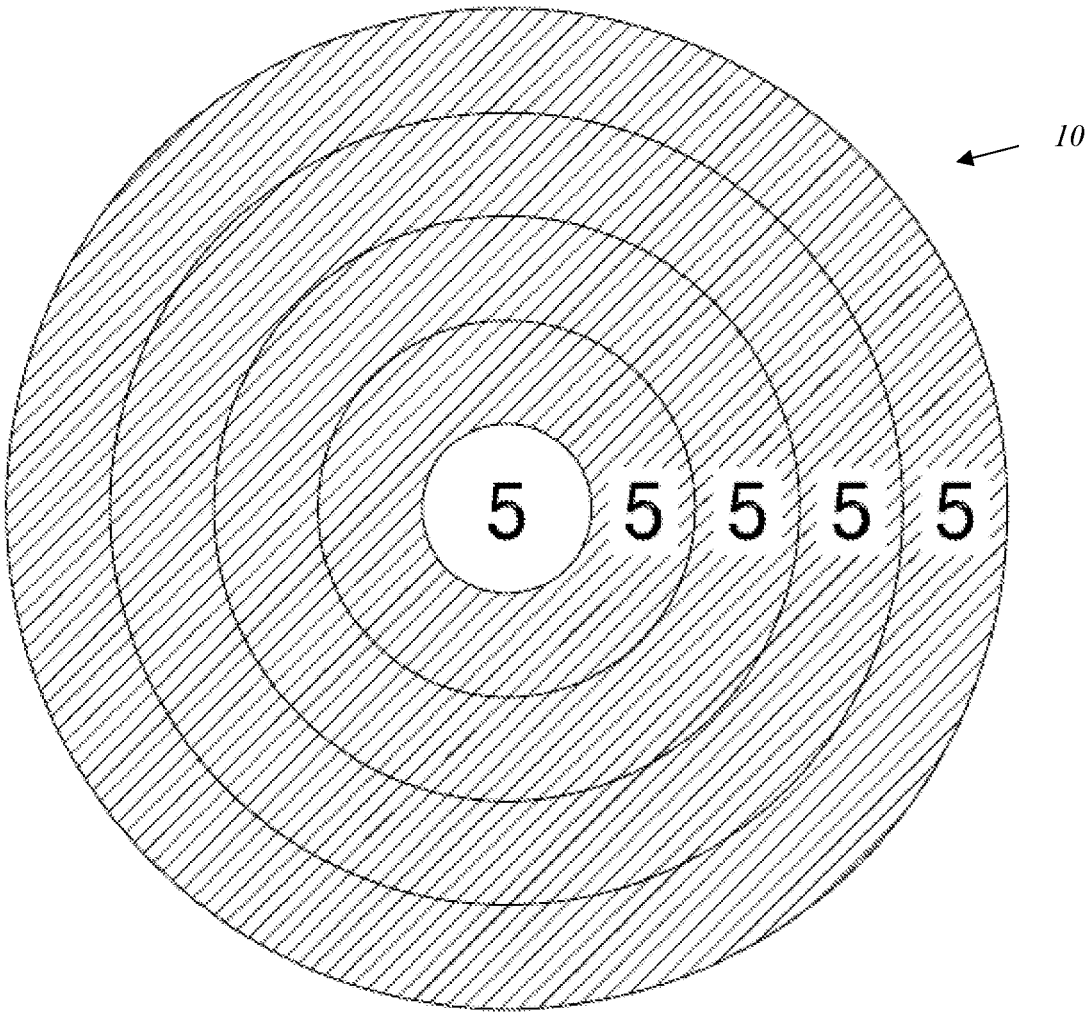
FIG. 6D illustrates that the four outer rings are closed thus making the four outer rings all worth 5 points each according to the Ball Game Rules as disclosed herein.
Figure 6E:
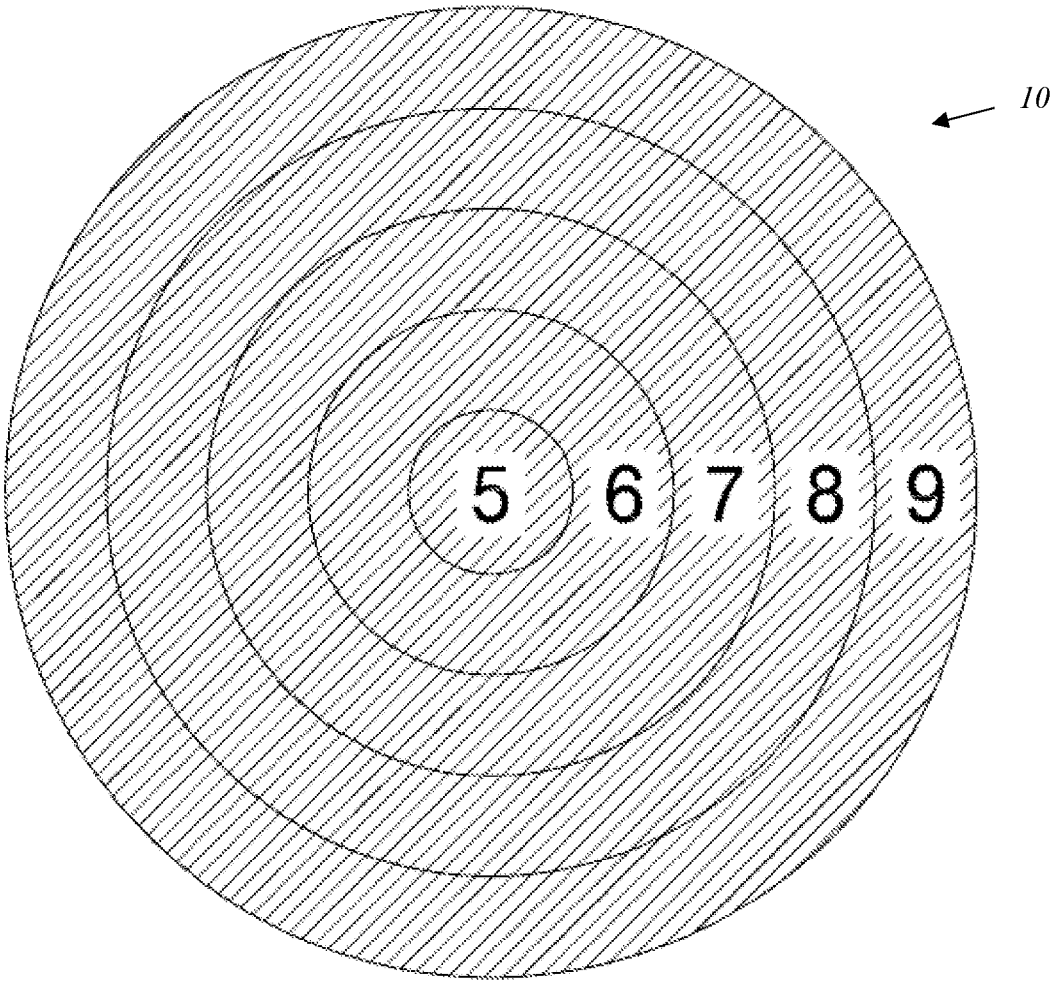

One of ordinary skill will appreciate that the rules provided are for at least one embodiment of the invention as disclosed. As scoring rules may be implemented without limitation or restriction which allow play on generally circular field having a suspended goal proximate the center of the field or court, as may be suitable for a particular application. In another embodiment of the invention, as discussed in detail herein, an embodiment of the game is disclosed herein as a ball game 10 played by 6 players against 6 players (6 on 6) and is played with a round ball (not shown) which could be similar to basketball or soccer ball, on a circular field. Similar to basketball, a score occurs when the ball successfully goes through the Goal 1. In at least one embodiment of the Ball Game 10, the field 15 is generally circular and may be comprised of multiple concentric rings (15-1 through 15-5) disclosed in FIG. 5. FIG. 6A is a top view of the Field 15 as shown at FIG. 5 with the dimensions removed and the value of points scored from each ring for playing the Ball Game 10 using the disclosed Goal 1 positioned in the center 15*a* of the field 15 according to the Ball Game Rules disclosed. FIG. 6A illustrates that the outer ring is closed thus making the two outer rings all worth 2 points each according to the Ball Game Rules disclosed and discussed herein. FIG. 6B illustrates that the two outer rings are closed thus making the three outer rings all worth 3 points each according to the Ball Game Rules disclosed and discussed herein. FIG. 6C illustrates that the three outer rings are closed thus making the four outer rings all worth 4 points each according to the Ball Game Rules disclosed and discussed herein. FIG. 6D illustrates that the four (4) outer rings are closed thus making the four outer rings all worth 5 points each according to the Ball Game Rules disclosed and discussed herein. FIG. 6E illustrates that all the rings are closed thus making the four outer rings all worth 5 points each.

Illustrative Ball Game Rules

The visiting team gets the ball first and is on offense. Each offensive player can set up and move anywhere they wish on the field, but the player with the ball must start OUTSIDE (out of bounds) the outermost ring when beginning the game. When a player has possession of the ball, he/she can run anywhere they wish within the ring they reside. However, in order to advance the ball towards the core into another ring, a player must pass the ball to a teammate. A traveling violation occurs when/if a player has possession of the ball and enters into an advancing ring without passing to a teammate. If the player in possession of the ball wishes to retreat away from the field center 15*a* (core), it is legal to cross over in another ring so long as he/she is moving away from the field center 15*a* (core). No offensive, nor defensive player can spend more than three (3) seconds in the field center 15*a* (core) without a shot being taken. The offensive team has 30 seconds in the form of a shot clock to attempt a shot.

Explanation of Offense

The Ball Game (CORE™) offense is all about passing and moving. It is a "make it, take it" style game, meaning if the offense scores, they reset and get the ball back. There are two levels of scoring necessary to win. One is total points scored, and the second is rings closed. The offense must earn their way into the field center 15*a* (core), so they have to score within the outermost ring before advancing to the next ring, and so on. When beginning the game, as illustrated in FIG. 5A, the outer ring (15-1) is worth 1 point. The next ring in (15-2) is worth 2, then the next ring in (15-3) is worth 3, the next ring in (15-4) is 4, and the field center 15*a* (core) is worth 5 points.

During play, the offense must start each new possession by "clearing" the ball past the ring that is due to be closed out, (i.e., the offensive team will begin the first possession of a game out of bounds, beyond the "1 ring" (15-1). If the offense is successful in scoring within the 1 ring (15-1), the new possession will then start within the 1 ring (15-1), or just outside 2 (15-2), with the objective of closing out the 2 ring (15-2), and so on, progressing towards the core 15*a*. If the offense scores within the outermost ring, they will receive the 1 point available for the score and will have then "closed out" the outer ring as illustrated by FIG. 6.

Each ring must then be closed out in sequence. This is the main offensive objective of the game. However, if the offensive team has an opportunity to score within a ring or within the core, yet is out of sequence, the offensive team will be awarded the appropriate amount of points for the score, but will not successfully close out the ring/core. The offense will then have to reset into a new possession in the outermost ring not yet closed out.

If a team has successfully closed out all five (5) rings, but is still down in total points scored, the points for each ring will switch from the beginning of the game to where now the core is worth 5 points, the next ring from the core is worth 6, next is worth 7, then 8, and the outmost ring is worth 9 points as illustrated in FIG. 6E.

When closing rings out in sequence, once the outermost ring is closed out, the adjacent ring absorbs that ring and is considered one larger ring worth 2 points regardless of if shot was made again in the previously closed out 1st ring. And so on, as the rings become sequentially closed out as shown in FIG. 6A. However, in order to successfully close out a ring, a score must happen within the ring being closed out.

If the offensive team successfully performs what is known in basketball as the "alley oop", meaning a 10*b* style pass towards the goal is caught in mid-air and shot before the receiving player touches the ground, the offensive team then has the choice to either take the points from where the alley oop was received and then shot, or to take the point(s) from the ring the ball was initially passed, and close out the ring from which the ball was initially passed assuming the ball was passed within the ring that is next in the sequence to be closed out. The same choice as stated above, also applies to the offense when/if a ball is tipped into the goal off of a rebound. The first team to successfully close out all five (5) rings in sequence, and have the highest point total wins the game. In order to win the entire match, it is best 2 out of 3, 3 out of 5, or 4 out of 7 games (pending on ages and times constraints, etc.).

Explanation of Defense

The CORE defense is a "king of the mountain" mentality. Only in this case, the mountain has been flattened to an 84 ft diameter circle, and the field center (15*a*) core is the "top" of the mountain.

The defense constantly shifts around the field center (15*a*) core with the flow of the offense, protecting the core, and getting more and more intense as the offense progresses toward the core.

If the defense successfully stops the offense from scoring either through a turnover, or a rebound, the defense will transition into offense. This is referred to as a "transition play". In a transition play, once the defensive team recovers the ball and becomes the offensive team, they must "clear" the ball out past the outermost ring (15-1), or to the outermost ring that their team has not yet closed out.

If the originally defensive team successfully scores during a transition play, that team gets the choice of either taking the points scored (and closing out a ring, if applicable), or wiping out the opponents most recently closed out ring.

If the originally defensive team does not score during the transition play, and the originally offensive team regains possession, the transition play rules no longer apply. The originally offensive team will simply revert back to the normal offensive rules.

If the original defensive team maintains possession, but the transition play is stopped due to a foul or dead ball, the transition play is no longer effective. The originally defensive team will simply reset, substitute players if necessary, and set up for a new offensive possession in the appropriate ring.

Explanation of Jump Ball

If a jump ball occurs, the two players involved in the jump ball have 30 seconds to "wrestle" the ball away from one another. No other teammates can assist in the jump ball (no dog-piles). When/if a player clearly gains possession of the ball within the 30 second time frame, that team will then reset for a new offensive possession. If the 30 second time limit expires and neither player has gained clear possession, the possession will alternate between the two teams. Since the visiting team gets first possession when the game starts, if the first jump ball of the game expires within the thirty (30) second time limit without clear possession, the possession will go to the home team.

Explanation of Loose Ball

At certain moments within the game of CORE, there will be times when the ball gets loose and neither team has clear possession. If at any moment, It proves to be advantageous to kick the ball to a teammate, it is legal to do so. Any "soccer-style" ball movement is perfectly legal, but possession is not gained until a player clearly has the ball in his or her hands. If however, an opponent is struck by a kick, a foul occurs. If this style of play ensues, it is still the offensive team's responsibility to make a shot attempt within the 30 second shot clock.

Explanation of Goaltending

Once the ball has made contact with any facet of the goal, it is legal for both offense and defense to intervene with the shot.

Explanation of Fouls/Violations

No tackling, no tripping, no shoving, no holding, no grabbing, no clubbing. There is no punching an opponent. However, it is legal to punch the ball, so long as player is not struck with the punch. Further, there is no kicking an opponent. It is, however, legal to kick the ball, so long as a player is not struck with the kick. An offensive player taking a shot, must be allowed to elevate, shoot, and land safely without defensive interference. If an offensive player elevates for a shot, that player must either shoot or pass before landing. A traveling violation occurs if that player lands and still has possession of the ball. If a player is fouled in the act of shooting, that player gets one free shot attempt within the ring the foul was committed. The defensive player that committed the foul can stand in front of the player shooting the free shot but must not be within the same ring as the player shooting. All other players for both teams will position themselves around the circumference of the core. Players cannot enter the core until the ball leaves the shooters hands. If the foul was committed within the field center (15*a*) core, the offensive player that was fouled, and the defensive player that committed the foul will play one on one within the core, for one shot attempt. If the defensive player gains possession without fouling, that players team resets for a new offensive possession. If the defensive player commits another foul while in the one-on-one situation, the offensive team automatically receives the points.

It is to be understood that the disclosure is not limited in its application to the details of construction and the arrangements of components set forth in the following description or illustrated in the drawings. The present disclosure is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description, and do not alone indicate or imply that the device or element referred to must have a particular orientation. In addition, terms such as "first", "second", and "third" are used herein and in the appended claims for purposes of description and are not intended to indicate or imply relative importance or significance.

Although the illustrative apparatuses and processes described and disclosed herein may be configured for use with fasteners comprised primarily of metallic materials and their alloys, the scope of the present disclosure is not so limited and extends to any beneficial and/or advantageous use and/or configuration thereof without limitation unless so indicated in the following claims. The materials used to construct the apparatuses and/or components thereof may vary depending on the specific application thereof, but it is contemplated that polymers, synthetic materials, metals, metal alloys, natural materials, and/or combinations thereof may be especially useful in some applications. Accordingly, the above-referenced elements may be constructed of any material known to those skilled in the art or later developed, which material is appropriate for the specific application of the present disclosure without departing from the spirit and scope of the present disclosure unless so indicated in the following claims.

Having described preferred aspects of the various processes and apparatuses, other features of the present disclosure will undoubtedly occur to those versed in the art, as will numerous modifications and alterations in the embodiments and/or aspects as illustrated herein, all of which may be achieved without departing from the spirit and scope of the present disclosure. Accordingly, the apparatuses and methods and/or embodiments thereof as pictured and described herein are for illustrative purposes only, and the scope of the present disclosure extends to all processes, apparatuses, and/or structures for providing the various benefits and/or features of the present disclosure unless so indicated in the following claims, such as all similar apparatuses for allowing modification or improvement of a Ball Game and Method of Playing including using the various elements disclosed herein as part of the a Ball Game and Method of Playing as suitable for the application.

While various apparatuses and methods according to the present disclosure have been described in connection with preferred aspects and specific examples, it is not intended that the scope be limited to the particular embodiments and/or aspects set forth, as the embodiments and/or aspects herein are intended in all respects to be illustrative rather than restrictive. Accordingly, the processes and embodiments pictured and described herein are no way limiting to the scope of the present disclosure unless so stated in the following claims.

Although several figures are drawn to accurate scale, any dimensions provided herein are for illustrative purposes only and in no way limit the scope of the present disclosure unless so indicated in the following claims. It should be noted that the apparatuses and methods disclosed herein are not limited to the specific embodiments pictured and described herein, but rather the scope of the inventive features according to the present disclosure is defined by the claims herein. Modifications and alterations from the described embodiments will occur to those skilled in the art without departure from the spirit and scope of the present disclosure.

Any of the various features, components, functionalities, advantages, aspects, configurations, process steps, process parameters, etc. of the apparatuses and methods disclosed herein may be used alone or in combination with one another depending on the compatibility of the features, components, functionalities, advantages, aspects, configurations, process steps, process parameters, etc. Accordingly, a nearly infinite number of variations of the present disclosure exist. Modifications and/or substitutions of one feature, component, functionality, aspect, configuration, process step, process parameter, etc. for another in no way limit the scope of the present disclosure unless so indicated in the following claims.

It is understood that the present disclosure extends to all alternative combinations of one or more of the individual features mentioned, evident from the text and/or drawings, and/or inherently disclosed. All of these different combinations constitute various alternative aspects of the present disclosure and/or components thereof. The embodiments described herein explain the best modes known for practicing the apparatuses, methods, and/or components disclosed herein and will enable others skilled in the art to utilize the same. The claims are to be construed to include alternative embodiments to the extent permitted by the prior art.

Unless otherwise expressly stated in the claims, it is in no way intended that any process or method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

What is claimed is:

1. A goal structure configured for use in a ball game comprising:

a) An upper ring defining an upper portion of the goal structure, the upper ring having a center and configured to allow suspension of the goal structure above a playing field;

b) A lower ring defining a lower portion of the goal structure, the lower ring having a center;

c) A pole having an upper end and a lower end, wherein the upper end of the pole is connected to the center of the upper ring and wherein the lower end of the pole extends through the center of the lower ring to create a space to receive a ball;

d) At least one chain connecting the lower ring and the lower end of the pole; and, e) At least one hoop positioned to connect the lower end of the pole to the lower ring so that a there is a gap between the at least one hoop and the at least one chain to allow the ball to exit the goal structure.

2. The goal structure according to claim 1 wherein the at least one hoop and the at least one chain create action upon receipt of a ball.

3. The goal structure according to claim 1 wherein the upper end of the pole is configured with eyes to support attachment and suspension above the playing field.

4. The goal structure according to claim 1 wherein the upper ring includes a top cap to deflect a ball.

5. The goal structure according to claim 1 wherein the upper ring includes a top cap to deflect a ball, the top cap configured with eyes to support attachment and suspension above the playing field.

6. The goal structure according to claim 1 having at least three chains connected between the lower end of the pole and the lower ring, the at least three chains positioned around the circumference of the lower ring.

7. The goal structure according to claim 6 having at least three hoops connected between the lower end of the pole and the lower ring, the at least three hoops equidistantly positioned around the circumference of the lower ring.

8. The goal structure according to claim 1 positioned above the playing field, the playing field further comprising:

a) A center portion having a circular shape and having a defined diameter, wherein the center portion is positioned directly below the goal structure;

b) A first ring surrounding the center portion and having a defined width;

c) A second ring surrounding the first ring and having a defined width;

d) A third ring surrounding the second ring and having a defined width; and, e) A fourth ring surrounding the third ring and having a defined width.

9. The goal structure according to claim 8 wherein the defined diameter of the center portion of the playing field is six feet.

10. The goal structure according to claim 8 wherein the defined width of the first ring is nine feet.

11. The goal structure according to claim 8 wherein the defined width of the second ring is nine feet.

12. The goal structure according to claim 8 wherein the defined width of the third ring is nine feet.

13. The goal structure according to claim 8 wherein the defined width of the fourth ring is nine feet.

* * * * *